US009415906B2

(12) United States Patent
Kato

(10) Patent No.: US 9,415,906 B2
(45) Date of Patent: Aug. 16, 2016

(54) CAP AND CONTAINER PROVIDED WITH SAME

(71) Applicant: Takuya Kato, Fujisawa (JP)

(72) Inventor: Takuya Kato, Fujisawa (JP)

( * ) Notice: Subject to any disclaimer, the term of this patent is extended or adjusted under 35 U.S.C. 154(b) by 0 days.

(21) Appl. No.: 14/696,065

(22) Filed: Apr. 24, 2015

(65) Prior Publication Data

US 2015/0225134 A1 Aug. 13, 2015

Related U.S. Application Data

(63) Continuation-in-part of application No. PCT/JP2013/080854, filed on Nov. 15, 2013.

(30) Foreign Application Priority Data

Nov. 21, 2012 (JP) ..... 2012-254954

(51) Int. Cl.

*B65D 41/34* (2006.01)
*B65D 50/04* (2006.01)
*B65D 41/04* (2006.01)

(52) U.S. Cl.

CPC ..... *B65D 41/34* (2013.01); *B65D 41/0471* (2013.01); *B65D 50/04* (2013.01); *B65D 2101/0076* (2013.01)

(58) Field of Classification Search

CPC ..... B65D 41/08; B65D 41/04; B65D 41/06; B65D 41/0478; B65D 41/0471; B65D 41/34; B65D 41/3442; B65D 41/3447; B65D 41/3457; B65D 1/0238; B65D 50/04; B65D 50/046; B65D 55/024; B65D 55/02; B65D 17/24

USPC ..... 220/214, 276, 266, 265, 296, 293, 288, 220/319, 315, 324, 325; 215/258, 253, 250, 215/274, 273, 218, 217, 216, 330, 336, 329, 215/316, 276, 252, 283, 280

See application file for complete search history.

(56) References Cited

U.S. PATENT DOCUMENTS 3,603,472 A * 9/1971 Lecinski, Jr. ..... B65D 41/08 215/253
4,105,132 A * 8/1978 Keeler ..... B65D 50/046 215/216

(Continued)

FOREIGN PATENT DOCUMENTS

CN 1143351 A 2/1997
JP S49-97255 U 8/1974

(Continued)

OTHER PUBLICATIONS

Feb. 25, 2014 International Search Report issued in International Application No. PCT/JP2013/080854.

(Continued)

*Primary Examiner* — Robert J Hicks
(74) *Attorney, Agent, or Firm* — Oliff PLC

(57) ABSTRACT

A cap is for a container body including a mouth portion having an upper potion provided with a thread, a middle portion provided with an annular bead portion, and a lower portion provided with an annular shoulder portion. The cap includes a cap portion, a ring portion, and the locking mechanism. The ring portion serves as a tamper-evident ring configured to be connected to the lower end of the cap portion through a breakaway part. The ring portion has an elastic piece folded and anchored on the annular bead portion. The ring portion is rotatably provided between the annular bead portion and the annular shoulder portion. The locking mechanism is configured to be operated by a rotational operation to prevent the cap portion from being unintentionally unscrewed.

8 Claims, 17 Drawing Sheets

(56) References Cited

U.S. PATENT DOCUMENTS

| | | | | | |
|---|---|---|---|---|---|
| 4,153,174 | A * | 5/1979 | Keeler | B65D 41/3423 | 215/250 |
| 4,567,991 | A | 2/1986 | Anderson | | |
| 4,570,810 | A * | 2/1986 | Hawkins | B65D 50/046 | 215/253 |
| 5,328,046 | A * | 7/1994 | Kutz | B65D 21/022 | 206/509 |
| 5,487,481 | A * | 1/1996 | Sander | B65D 41/3447 | 215/252 |
| 5,715,977 | A | 2/1998 | Goncalves | | |
| 2001/0019022 | A1 * | 9/2001 | Nakao | A45C 11/005 | 206/5.1 |
| 2006/0138072 | A1 | 6/2006 | Mishra | | |
| 2011/0297682 | A1 | 12/2011 | Kwon | | |

FOREIGN PATENT DOCUMENTS

| | | | |
|---|---|---|---|
| JP | S53-108558 | U | 8/1978 |
| JP | S57-9240 | Y2 | 2/1982 |
| JP | S63-62564 | U | 4/1988 |
| JP | H01168450 | U | 11/1989 |
| JP | 2006521516 | A | 9/2006 |
| JP | 2006341924 | A | 12/2006 |
| JP | 2010530834 | A | 9/2010 |
| JP | 2011184096 | A | 9/2011 |

OTHER PUBLICATIONS

May 26, 2015 International Preliminary Report on Patentability issued in International Application No. PCT/JP2013/080854.

Sep. 11, 2015 Office Action issued in German Patent Application No. 112013005572.4.

Dec. 2, 2015 Office Action issued in Chinese Patent Application No. 201380060538.5.

Mar. 29, 2016 Office Action issued in Japanese Patent Application No. 2012-254954.

* cited by examiner

CAP AND CONTAINER PROVIDED WITH SAME

CROSS REFERENCE TO RELATED APPLICATION

This application claims priority from Japanese Patent Application No. 2012-254954 filed Nov. 21, 2012. This application is also a continuation-in-part of International Application No. PCT/JP2013/080854 filed Nov. 15, 2013 in Japan Patent Office as a Receiving Office. The contents of these applications are incorporated herein by reference.

TECHNICAL FIELD

The present invention relates to a container formed of a plastic, such as polyethylene terephthalate, metal, or the like, and a cap used to close the mouth of the container.

BACKGROUND

Japanese Patent Application Publication No. 2011-184096 and Japanese Examined Utility Model Application Publication No. S57-009240 disclose a conventional cap and container that are configured of a cap portion and a ring portion. The container has a mouth part around which are formed a thread part in the upper portion, an annular bead in the middle portion, and an annular shoulder in the lower portion. The cap portion is screwed onto the thread part of the mouth part. The ring portion is coupled to the bottom of the cap portion through a breakaway part and has elastic pieces that fold back so as to be anchored against the annular bead. The ring portion functions to indicate when the cap portion has been unscrewed (i.e., when the breakaway part has been broken).

Thus, twisting off the cap portion detaches the ring portion from the cap portion at the breakaway part so that the ring portion remains around the mouth part of the container. In this way, the ring portion functions as a tamper-evident band indicating when the cap's seal has been broken.

SUMMARY

However, the conventional construction described above leaves open the possibility that the cap portion could become accidentally twisted open after being capped again (a resealing state), i.e. in a condition where the cap's initial seal (a shipment state) has been once broken. This unintentional opening of the conventional cap and container presents various problems depending on the content of the container. For example, when the container accommodates a carbonated beverage, the loss of carbonation caused by a broken seal can result in a flat beverage with loss in flavor. If the container accommodates a chemical solution or liquid medicine, vaporization or leakage of the solution due to the broken seal may compromise safety for infants and the elderly.

It is therefore an object of the invention to solve the problems. In this invention, a cap is for a container body including a mouth portion having an upper potion provided with a thread, a middle portion provided with an annular bead portion, and a lower portion provided with an annular shoulder portion. The cap includes a cap portion, a ring portion, and the locking mechanism. The cap portion is configured to be screwed with the thread. The cap portion has a lower end. The ring portion serves as a tamper-evident ring configured to be connected to the lower end of the cap portion through a breakaway part. The ring portion has an elastic piece folded and anchored on the annular bead portion. The ring portion is rotatably provided between the annular bead portion and the annular shoulder portion so that a rotational operation is performable on the ring portion. The locking mechanism is configured to be operated by the rotational operation to prevent the cap portion from being unintentionally unscrewed. The ring portion has an outer peripheral surface. The locking mechanism includes a protruding portion and an engaging protruding portion. The protruding portion is provided on the outer peripheral surface and has an end portion forming a wedge shape. The engaging protrusion portion is provided on the cap portion and is configured to be engaged with the protruding portion by the rotational operation for providing a locked state to prevent the cap portion from being unintentionally unscrewed. The engaging protrusion portion is also configured to be disengaged from the protruding portion by the rotational operation for providing an unlocked state.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
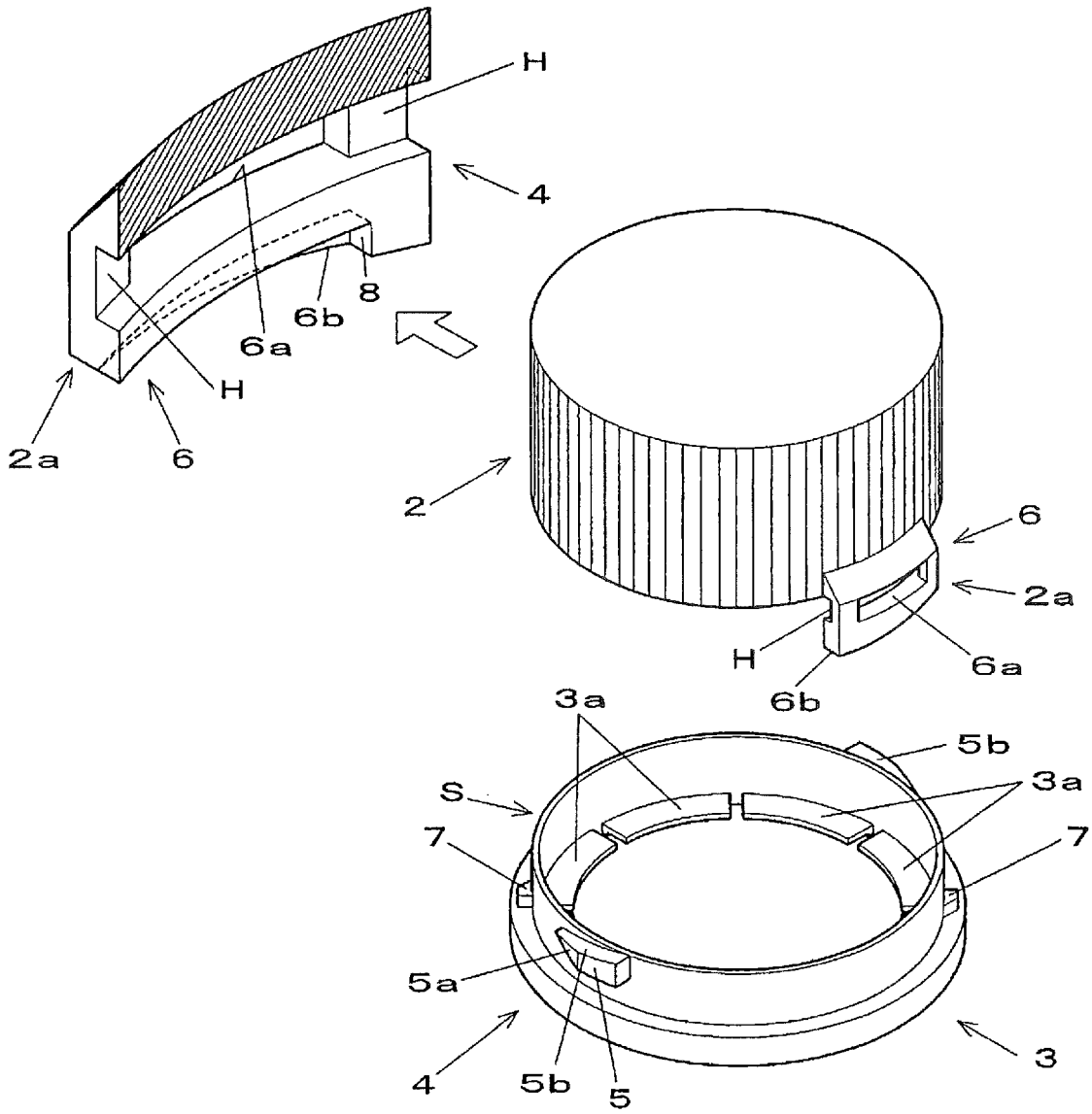
FIG. 1 is a perspective view according to a first embodiment of the present invention.
Figure 2:
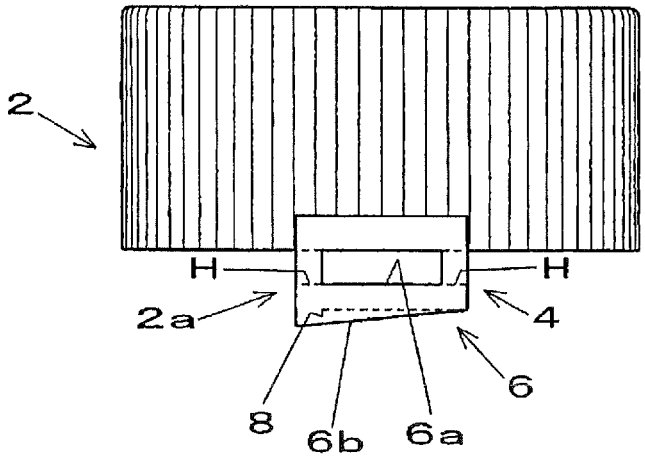
FIG. 2 is a side view of a cap portion according to the first embodiment of the present invention.
Figure 3:
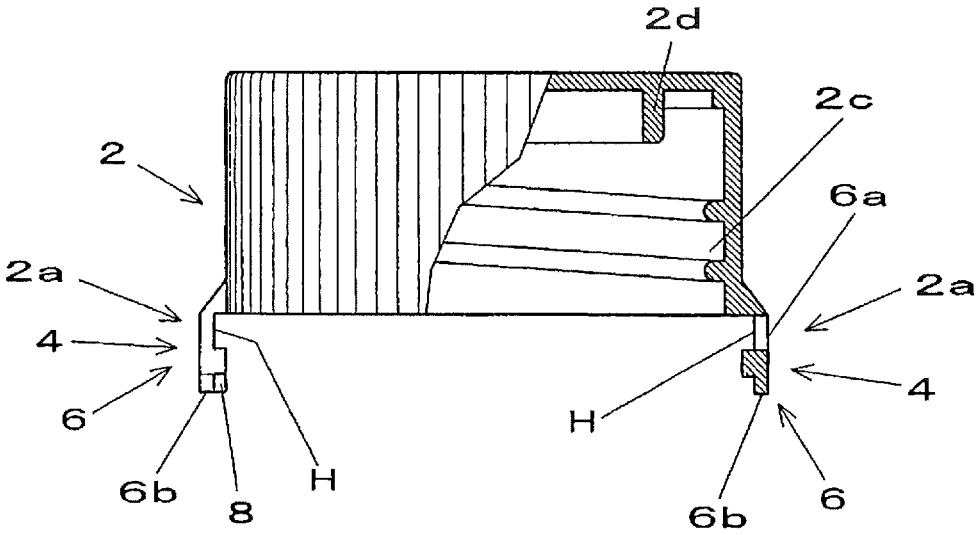
FIG. 3 is a side and sectional view of the cap portion according to the first embodiment of the present invention.
Figure 4:
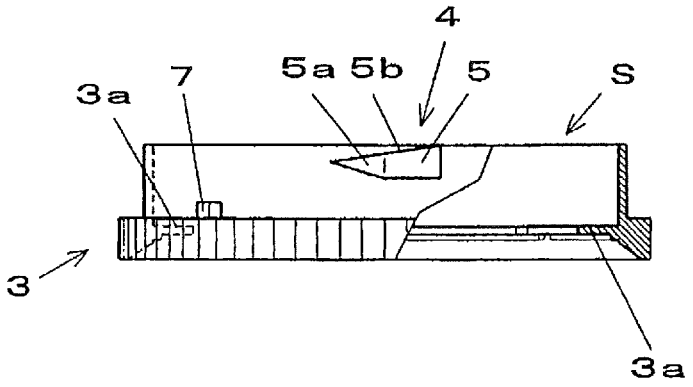
FIG. 4 is a side and sectional view of a ring portion according to the first embodiment of the present invention.
Figure 5:
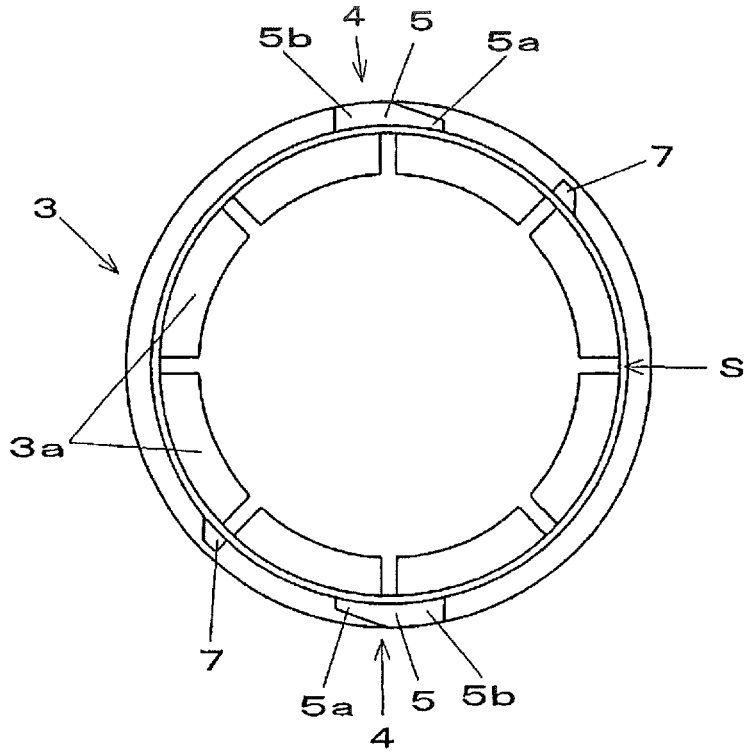
FIG. 5 is a plan view of the ring portion according to the first embodiment of the present invention.

A cap and a container according to a first embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the cap is disposed in an orientation in which it is intended to be used. In use, the cap is disposed as shown in FIG. 1.

FIGS. 1 through 31 illustrate embodiments of the present invention.

Figure 30:
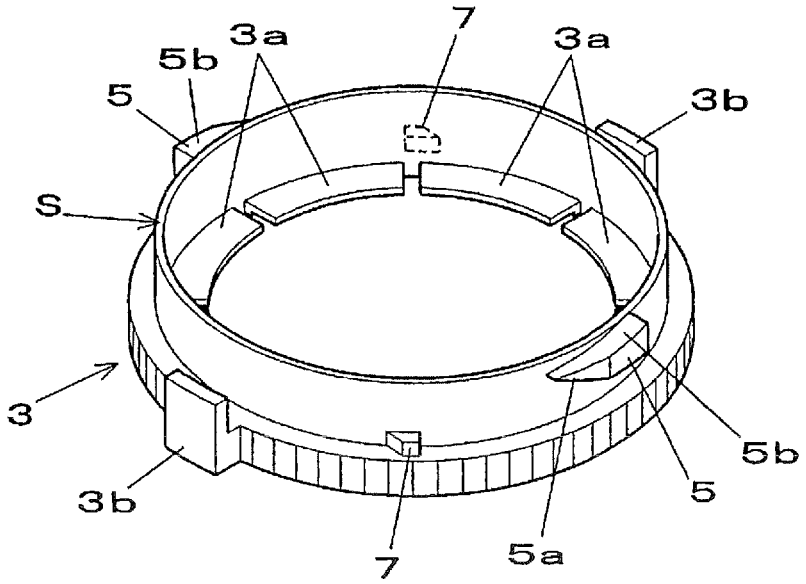
FIG. 30 is a perspective view of a ring portion according to a third embodiment of the present invention.
Figure 31:
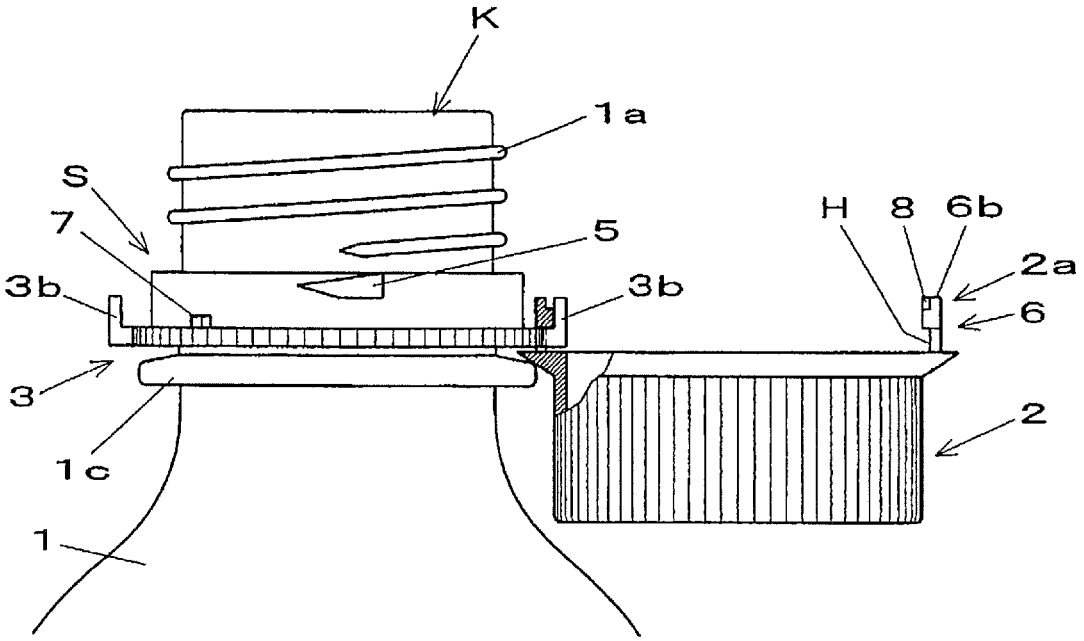
FIG. 31 is a side and sectional view according to the third embodiment of the present invention.

Of these, FIGS. 1 through 25 illustrate a first embodiment; FIGS. 26 through 29 illustrate a second embodiment; and FIGS. 30 and 31 illustrate a third embodiment.

The cap according to the first embodiment shown in FIGS. 1 through 25 primarily includes a cap portion 2 that screws over a mouth portion K of a container 1, and a ring portion 3. The container 1 has a male thread part 1*a* formed around the upper portion of the mouth portion K, an annular bead 1*b* formed around the middle portion of the mouth portion K, and an annular shoulder 1*c* formed around the lower portion of the mouth portion K. A female thread part 2*c* is formed in the inner circumferential surface of the cap portion 2. The cap portion 2 is screwed onto the mouth part K, with the male thread part 1*a* of the container 1 fitted into the female thread part 2*c* of the cap portion 2. An inner flange part 2*d* is formed on the inner surface of the top wall constituting the cap portion 2. The ring portion 3 is coupled to the bottom of the cap portion 2 through a breakaway part S. Elastic pieces 3*a* are provided on the inner circumferential surface of the ring portion 3 so as to be freely rotatable between the annular bead 1*b* and annular shoulder 1*c*. Each of the elastic pieces 3*a* has an end part that can be folded upward and rotatably anchored on the lower circumferential part of the annular bead 1*b*. When the cap portion 2 is rotated in an uncapping direction L, the ring portion 3 separates from the cap portion 2 at the breakaway part S. At this time, the ring portion 3 remains around the mouth portion K of the container 1. Thus, the ring portion 3 functions as a tamper-evident band indicating that the cap portion 2 has been unscrewed (i.e., evidence of manipulation).

Locking mechanisms 4 are configured to prevent unintentional rotation of the cap portion 2 in the uncapping direction L by applying a rotational operation M to the ring portion 3. As shown in FIGS. 1 through 5, each of the locking mechanisms 4 includes a protruding portion 5, and an engaging protrusion portion 6. The protruding portions 5 are provided on the outer circumferential surface of the ring portion 3 and have respective wedge-shaped end portions 5*a*. The engaging protrusion portions 6 can be placed in a locked state and an unlocked state. In the locked state, the protruding portions 5 are fitted into the respective engaging protrusion portions 6 when the ring portion 3 is rotated in the rotational operation M, preventing the cap portion 2 from being unintentionally rotated in the uncapping direction L. In the unlocked state, the protruding portions 5 are detached from the corresponding engaging protrusion portions 6, releasing the engaging protrusion portions 6 from their locked state.

In the first embodiment, two pairs of the protruding portions 5 and engaging protrusion portions 6 are provided, with the protruding portions 5 disposed on opposite sides of the outer circumferential surface of the ring portion 3 and the engaging protrusion portions 6 disposed on opposite sides of the outer circumferential surface of the cap portion 2. The protruding portions 5 and engaging protrusion portions 6 are arranged alternately at four positions at even intervals around the circumference of the ring portion 3.

Figure 15:
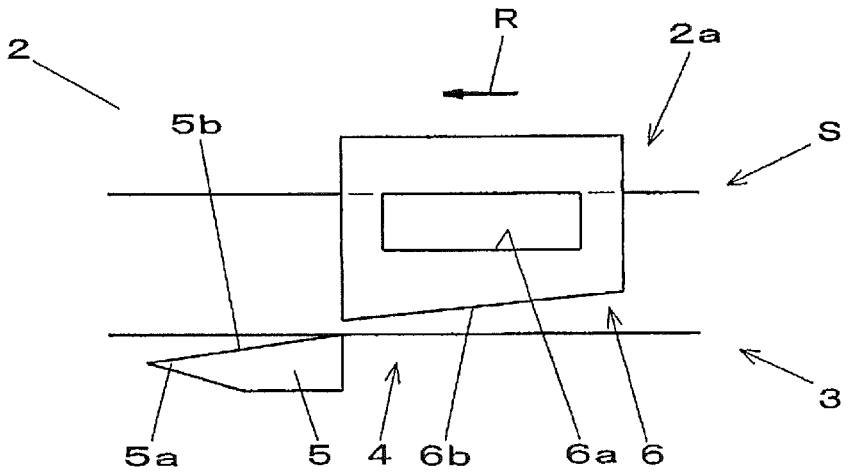
FIG. 15 is a side view during a capping process according to the first embodiment of the present invention.
Figure 16:
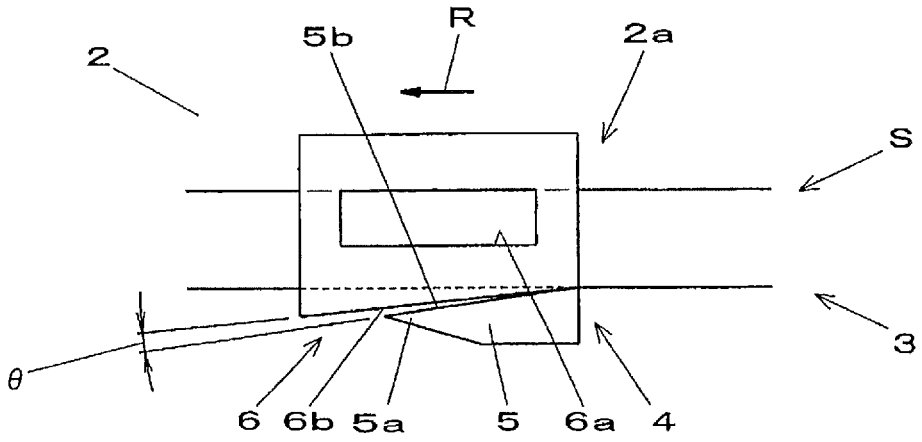
FIG. 16 is a side view during the capping process according to the first embodiment of the present invention.

Suspended portions 2*a* are provided in a cantilevered state on the outer circumferential surface of the cap portion 2. An engaging hole 6*a* is formed in each suspended portion 2*a* into which the corresponding protruding portion 5 can be fitted. Thin-walled groove parts H are formed in each suspended portion 2*a*, with one on each side of the engaging hole 6*a* in the circumferential direction. As shown in FIGS. 15 and 16, a sloped lower surface 6*b* is formed along the bottom of each suspended portion 2*a*. The sloped lower surface 6*b* slopes gradually downward in a capping direction R in which the cap portion 2 is rotated to be screwed onto the container 1. The degree of slope in the sloped lower surfaces 6*b* is set on the basis of the lead angle of the male thread part 1*a* relative to the rotational plane of the cap portion 2. A sloped upper surface 5*b* is formed on the top of each protruding portion 5. The sloped upper surfaces 5*b* slope gradually downward in the capping direction R of the cap portion 2, and the sloped lower surfaces 6*b* slope gradually downward in the capping direction R. The sloped upper surfaces 5*b* and sloped lower surfaces 6*b* are formed so as to be capable of opposing each other by making a gap angle 8, rather than making parallel surfaces. This gap angle θ helps to prevent the engaging protrusion portions 6 from getting stuck on the protruding portions 5.

Figure 8:
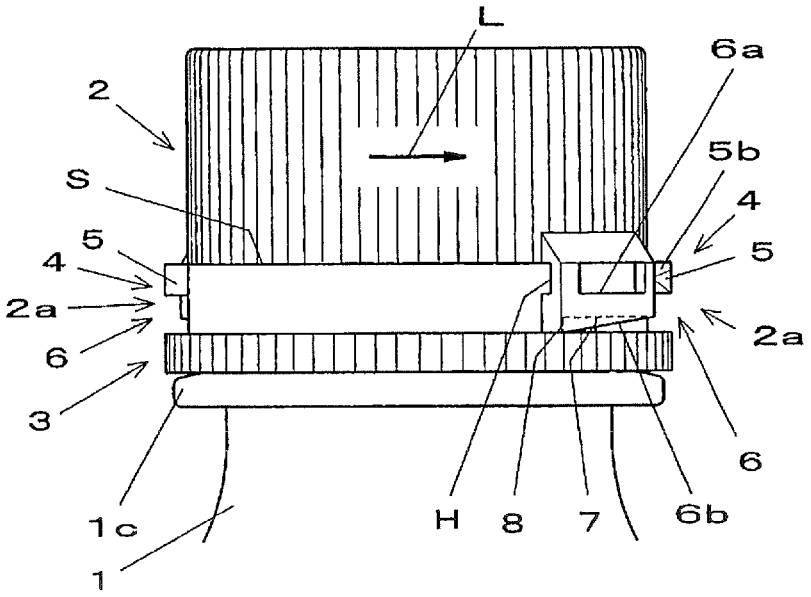
FIG. 8 is a side view during an uncapping process according to the first embodiment of the present invention.

As shown in FIGS. 1 and 8, restricting protrusions 7 are provided on opposite sides of the outer circumferential surface of the ring portion 3, and contact portions 8 are respectively disposed on the inner portions of the cap portion 2. When the cap portion 2 is rotated in the uncapping direction L, the contact portions 8 contact the restricting protrusions 7, preventing the protruding portions 5 from being fitted into the corresponding engaging protrusion portions 6.

Figure 9:
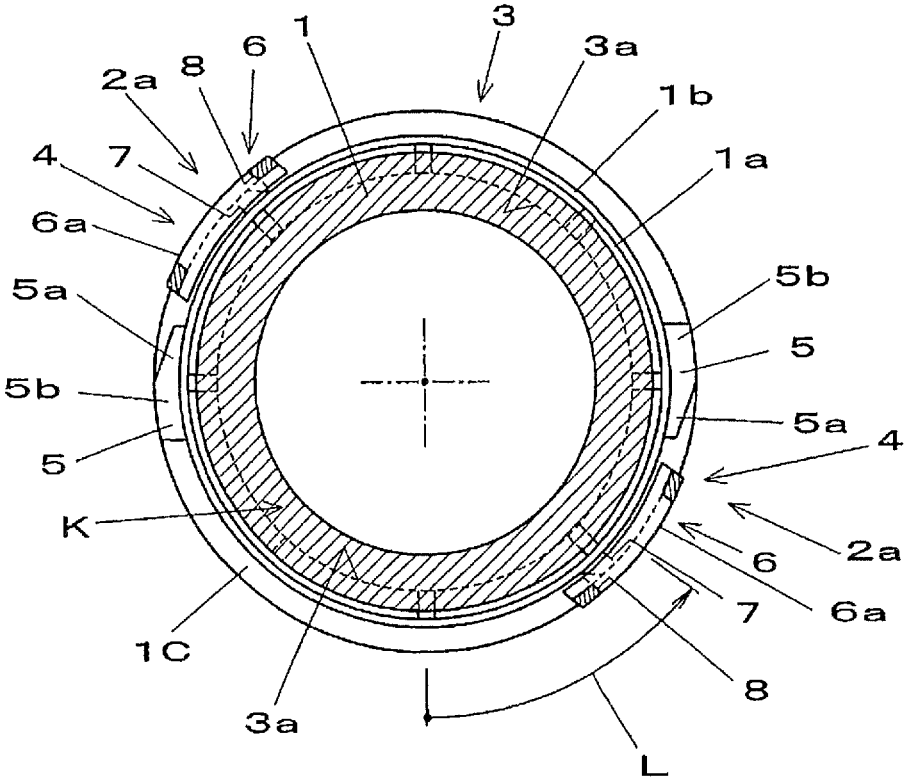
FIG. 9 is a plan and sectional view of FIG. 8 according to the first embodiment of the present invention.
Figure 10:
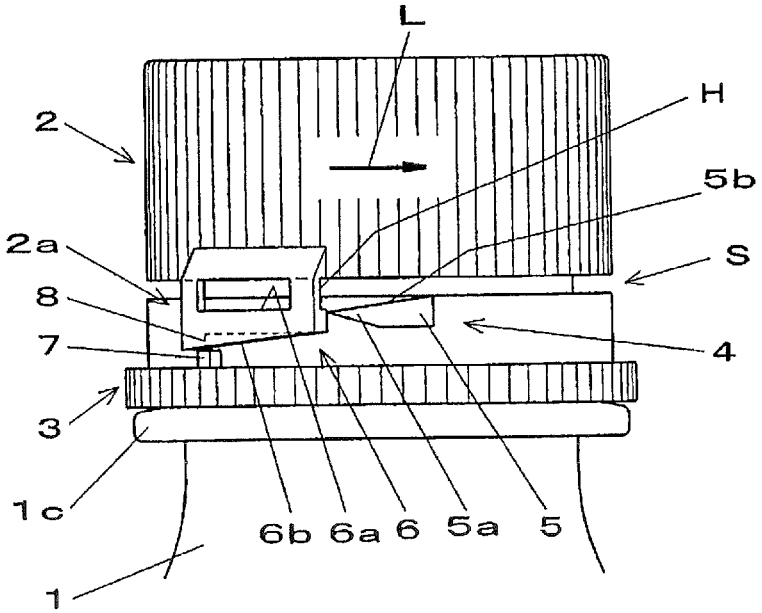
FIG. 10 is a side view during the uncapping process according to the first embodiment of the present invention.
Figure 11:
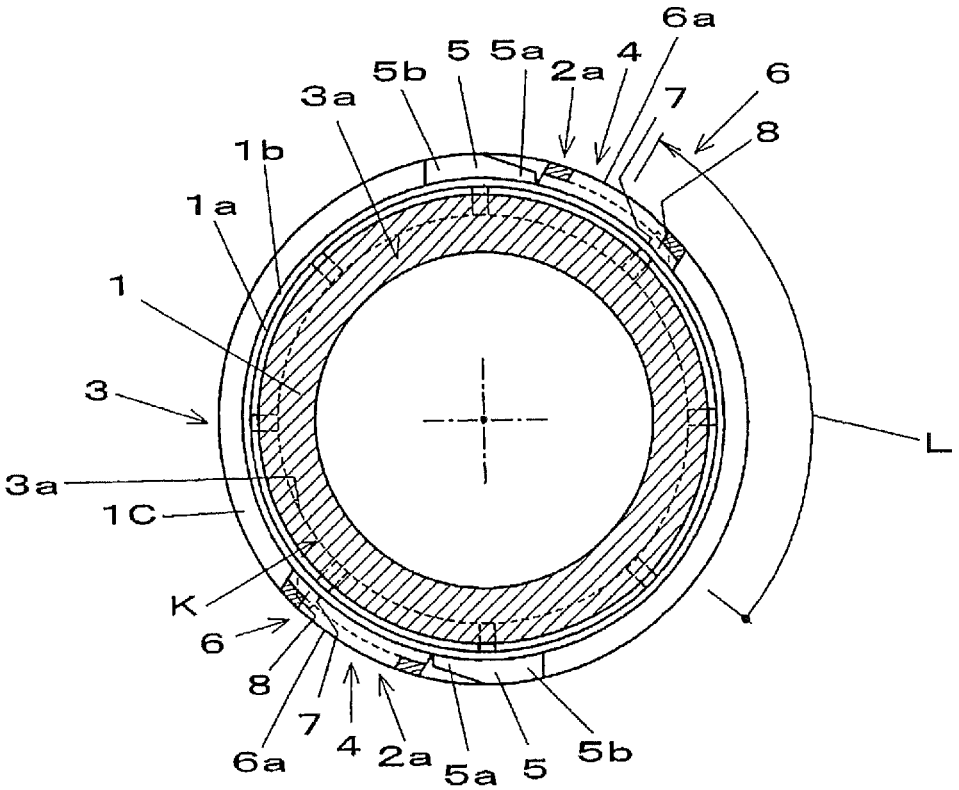
FIG. 11 is a plan and sectional view of FIG. 10 according to the first embodiment of the present invention.
Figure 12:
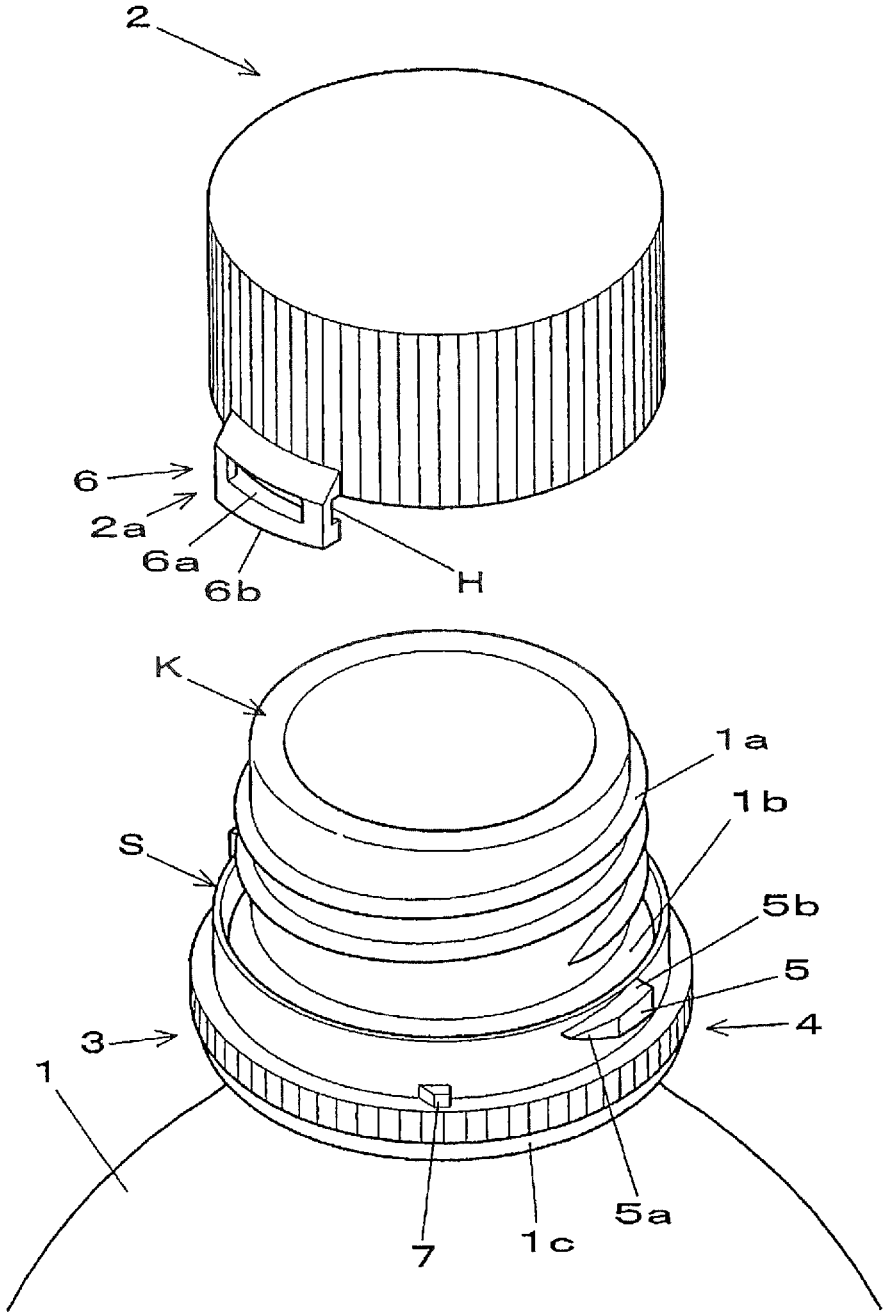
FIG. 12 is a perspective view in an uncapped state according to the first embodiment of the present invention.

Next, an uncapping process will be described with reference to FIGS. 6 through 12 on the basis of the structure of the first embodiment described above. In the initial state shown in FIGS. 6 and 7 (the state of the product at the time of purchase), the cap portion 2 and ring portion 3 are mounted over the mouth portion K of the container 1. When the cap portion 2 is rotated in the uncapping direction L (counterclockwise in a plan view), the cap portion 2 rises along the male thread part 1*a* that is fitted in the female thread part 2*c* until the cap portion 2 detaches from the ring portion 3 at the breakaway part S. As illustrated in FIGS. 8 and 9, the contact portions 8 on the corresponding engaging protrusion portions 6 come into contact with the corresponding restricting protrusions 7 on the ring portion 3, causing the ring portion 3 to begin rotating together with the cap portion 2 in the uncapping direction L. This contact prevents the protruding portions 5 from being fitted into the corresponding engaging protrusion portions 6 as the cap portion 2 is rotated in the uncapping direction L. As the cap portion 2 continues to be rotated in the uncapping direction L, the restricting protrusions 7 separate from the corresponding contact portions 8, as illustrated in FIGS. 10 and 11. Subsequently, the end portion 5*a* of each protruding portion 5 contacts the side surface of the corresponding suspended portion 2*a* on the cap portion 2, causing the ring portion 3 to once again rotate together with the cap portion 2 in the uncapping direction L. Eventually, the cap portion 2 becomes separated from the mouth portion K of the container 1, while leaving the ring portion 3 around the mouth portion K, as illustrated in FIG. 12, thereby completing the uncapping process.

Figure 6:
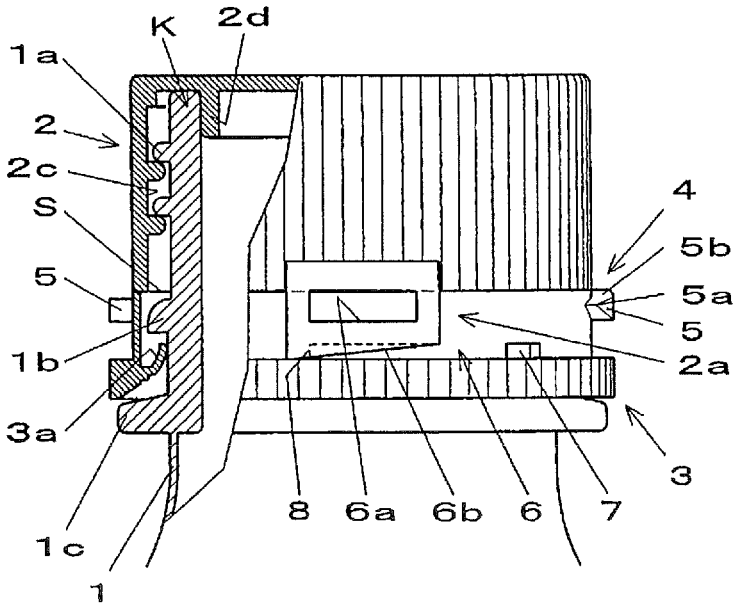
FIG. 6 is a side and partial sectional view in an initial state according to the first embodiment of the present invention.
Figure 7:
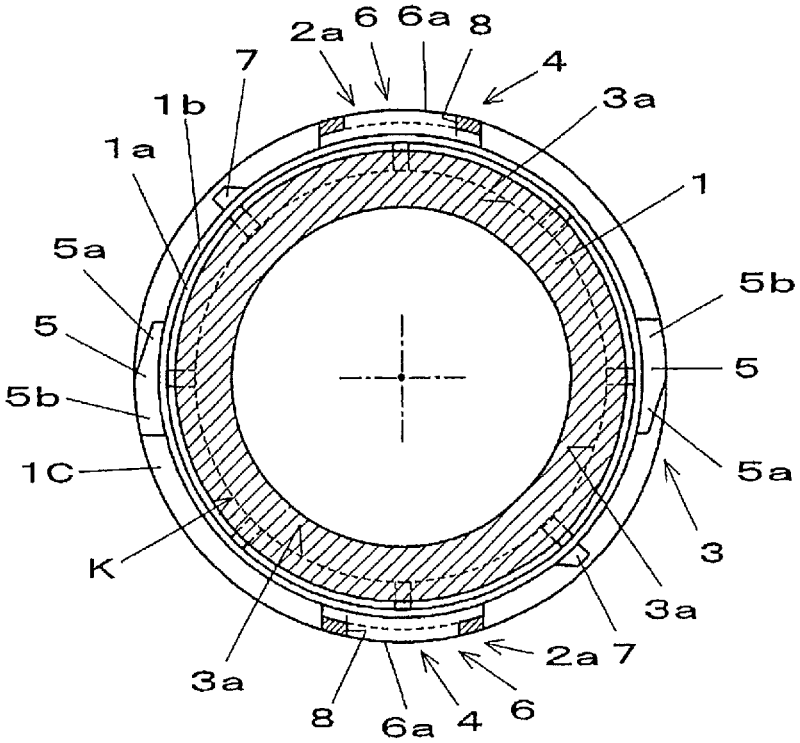
FIG. 7 is a plan and sectional view of FIG. 6 according to the first embodiment of the present invention.
Figure 13:
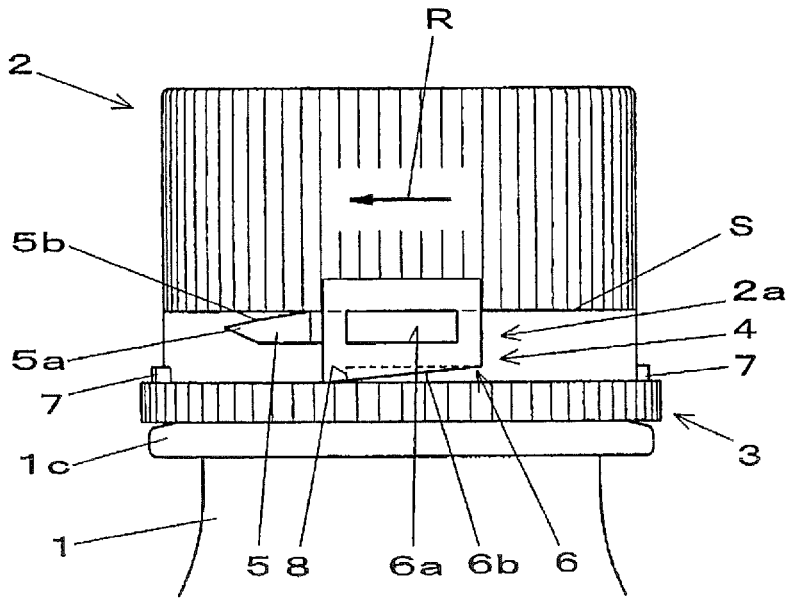
FIG. 13 is a side view during a capping process according to the first embodiment of the present invention.
Figure 14:
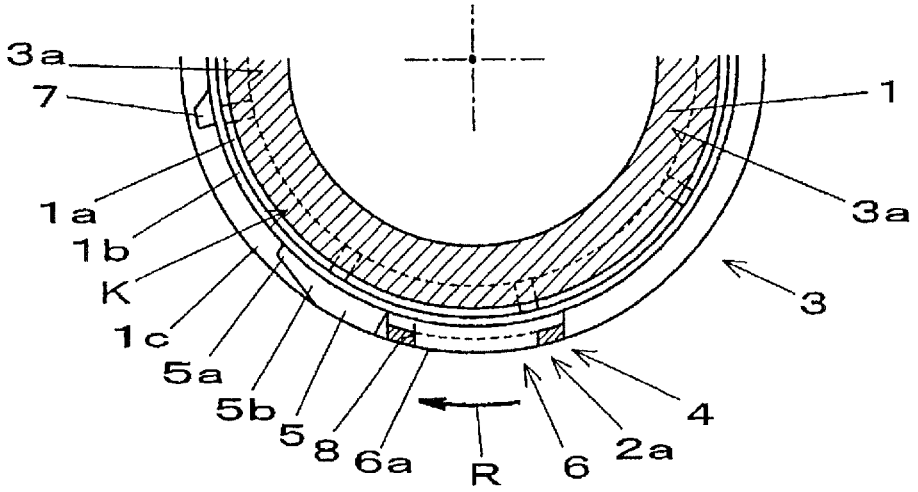
FIG. 14 is a plan and sectional view of FIG. 13 according to the first embodiment of the present invention.
Figure 17:
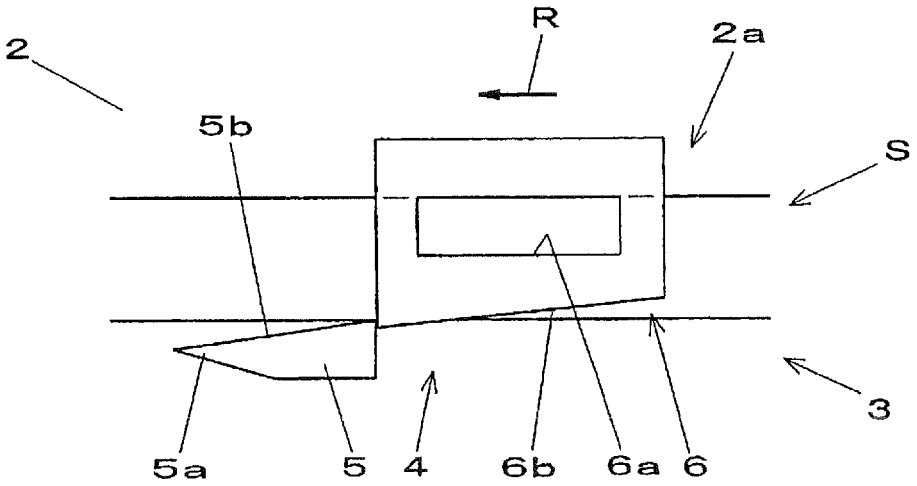
FIG. 17 is a side view during the capping process according to the first embodiment of the present invention.
Figure 18:
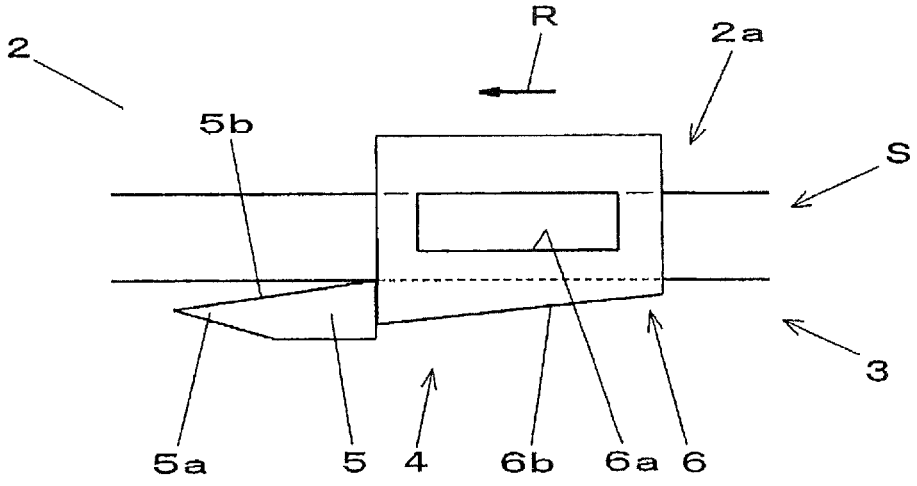
FIG. 18 is a side view during the capping process according to the first embodiment of the present invention.

Next, a capping process will be described with reference to FIGS. 13 through 18 beginning from the completion of the uncapping process. As illustrated in FIGS. 13 and 14, the cap portion 2 is rotated on the mouth portion K of the container 1 in the capping direction R (clockwise in a plan view) until side surfaces of the suspended portions 2*a* contact distal ends of the corresponding protruding portions 5. At this time, the ring portion 3 begins rotating together with the cap portion 2 in the capping direction R. Here, the cap portion 2 moves downward while rotating in the capping direction R due to the lead angle of the male thread part 1*a*, in a case where the engaging protrusion portions 6 and protruding portions 5 are in a noncontact state, as illustrated in FIGS. 15 and 16. Otherwise, if the engaging protrusion portions 6 come into contact with the protruding portions 5, as illustrated in FIG. 17, the ring portion 3 would simply rotate together with the cap portion 2, as illustrated in FIG. 18. Once the inner surface on the top wall of the cap portion 2 comes into contact with the top edge of the mouth portion K constituting the container 1, as illustrated in FIGS. 6 and 7, the cap portion 2 and ring portion 3 will once again meet at the breakaway part S and the capping process will be complete.

Figure 19:
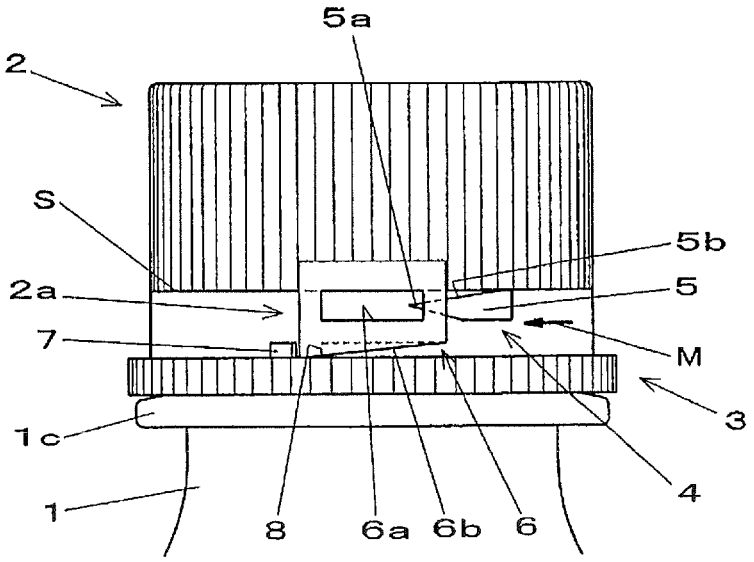
FIG. 19 is a side view during a locking operation according to the first embodiment of the present invention.
Figure 20:
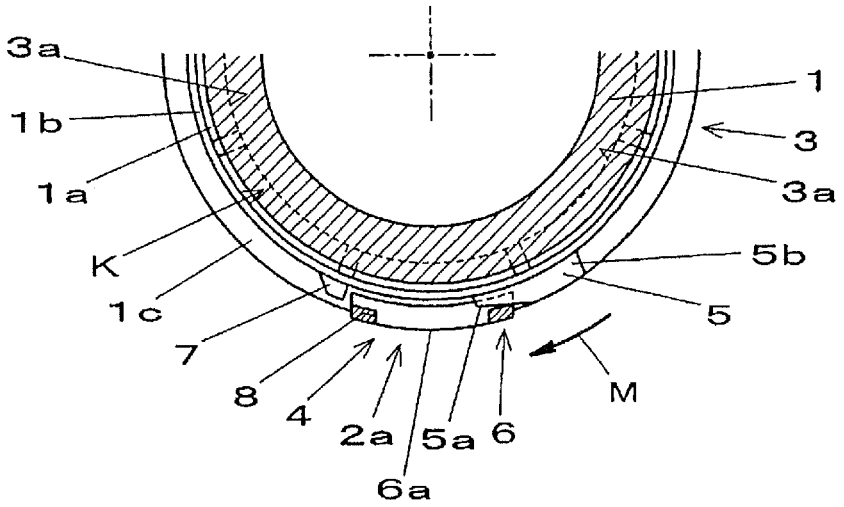
FIG. 20 is a plan and sectional view of FIG. 19 according to the first embodiment of the present invention.
Figure 21:
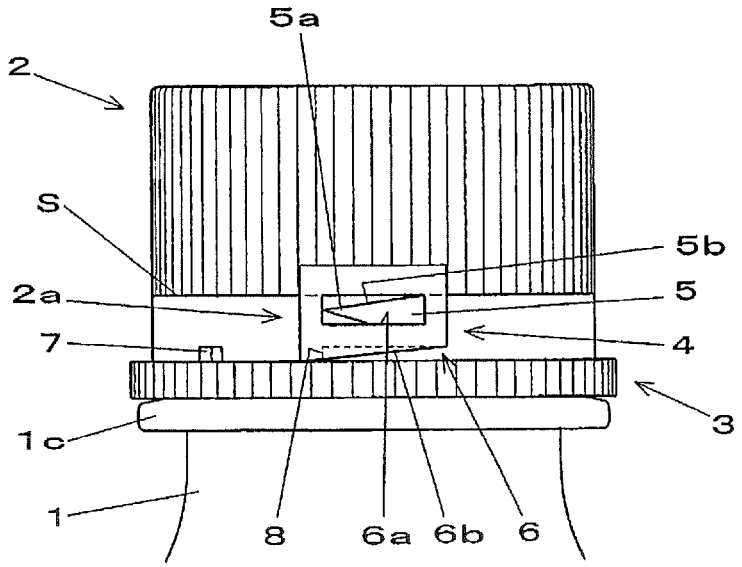
FIG. 21 is a side view in a locked state according to the first embodiment of the present invention.
Figure 22:
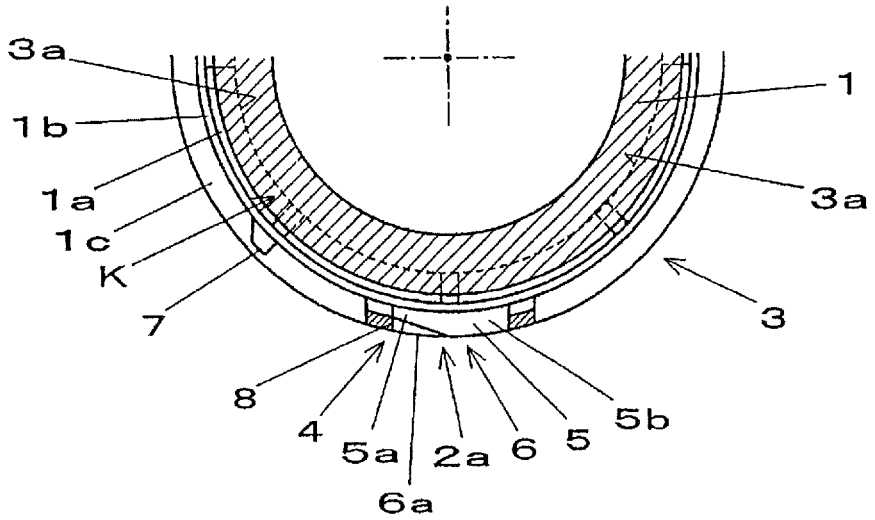
FIG. 22 is a plan and sectional view of FIG. 21 according to the first embodiment of the present invention.
Figure 23:
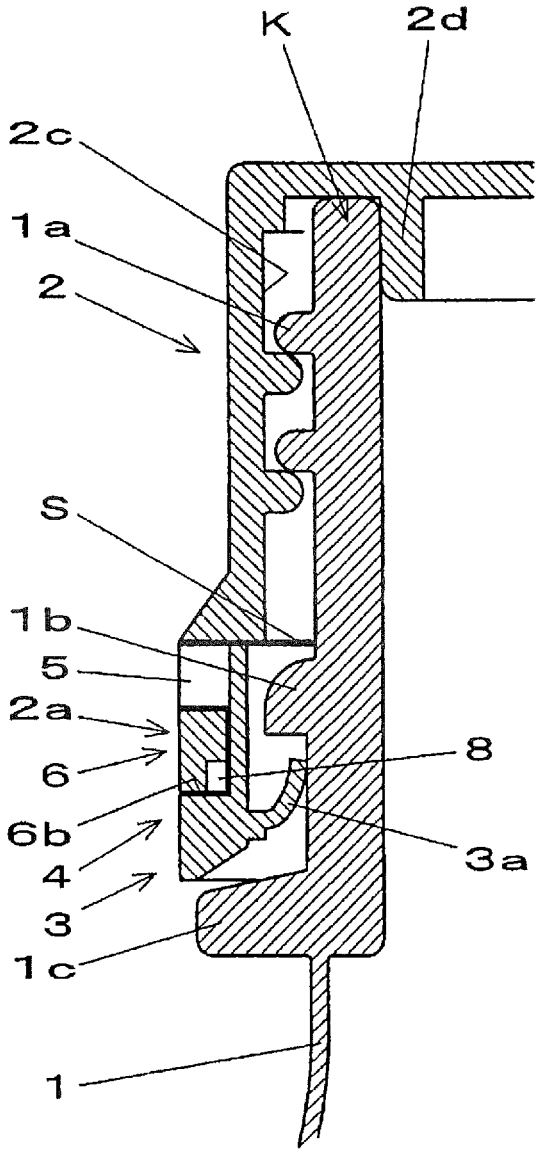
FIG. 23 is a partial section in side view of FIG. 21 according to the first embodiment of the present invention.
Figure 24:
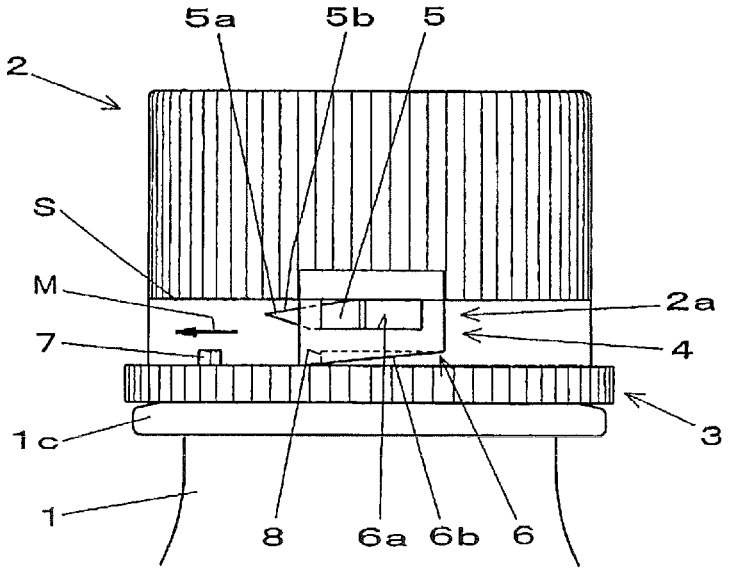
FIG. 24 is a side view during an unlocking operation according to the first embodiment of the present invention.
Figure 25:
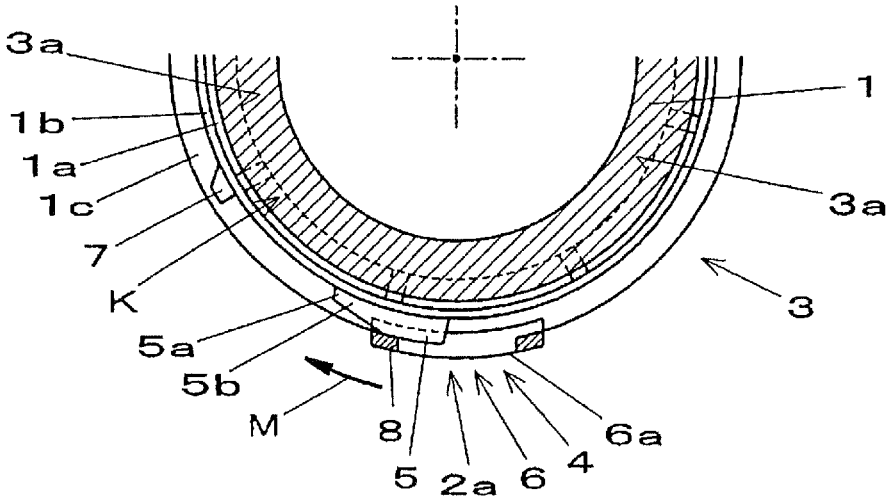
FIG. 25 is a plan and sectional view of FIG. 24 according to the first embodiment of the present invention.
Figure 26:
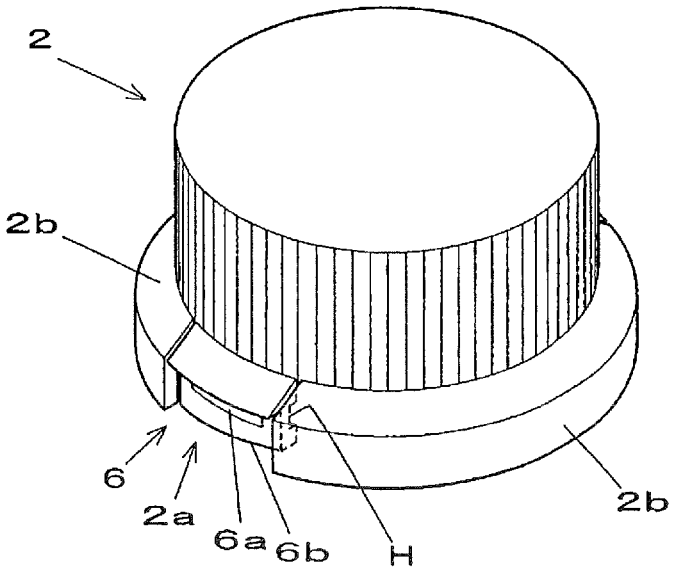
FIG. 26 is a perspective view of a cap portion according to a second embodiment of the present invention.
Figure 27:
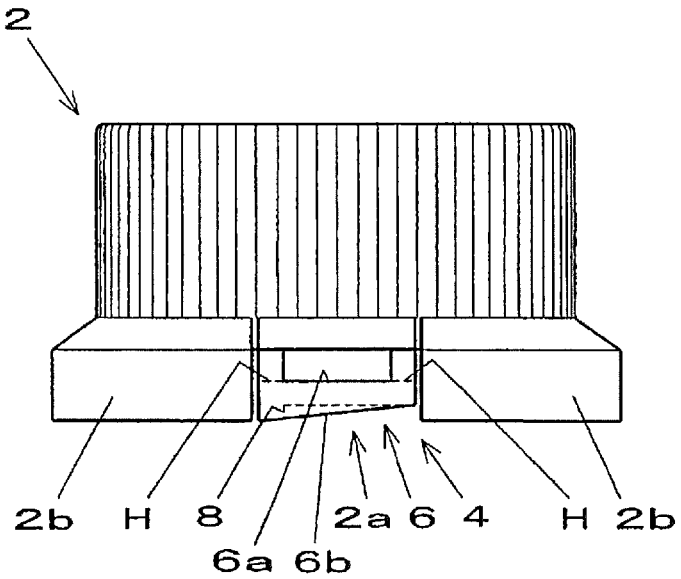
FIG. 27 is a side view of the cap portion according to the second embodiment of the present invention.
Figure 28:
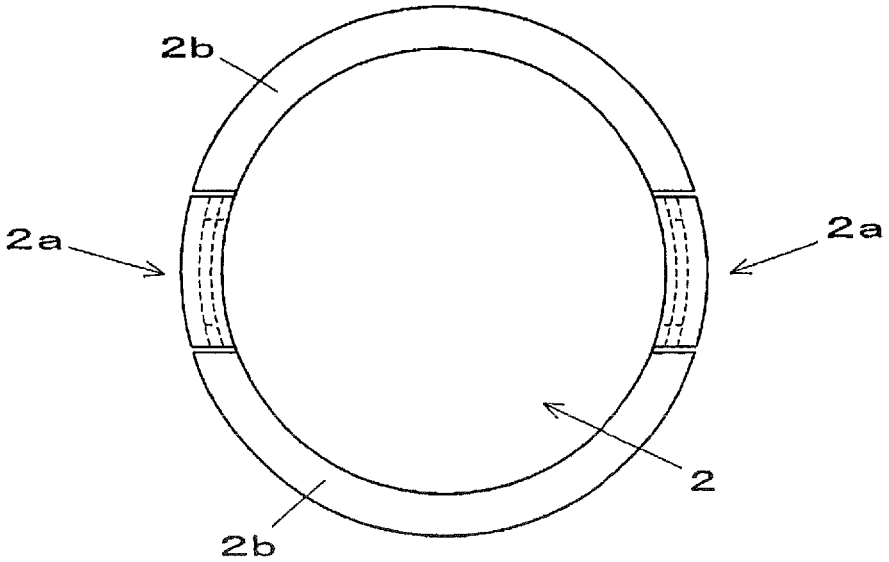
FIG. 28 is a plan view of the cap portion according to the second embodiment of the present invention.
Figure 29:
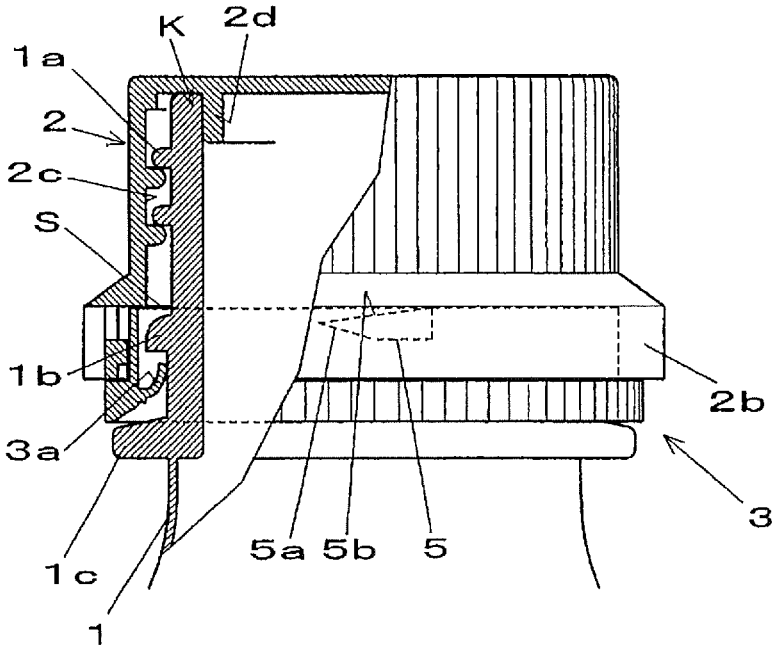
FIG. 29 is a side and sectional view according to the second embodiment of the present invention.

Next, a locking process for preventing the cap portion 2 from rotating unintentionally in the uncapping direction L after completing the capping process will be described with reference to FIGS. 19 through 25. When the ring portion 3 is rotated by the rotational operation M (clockwise rotation in a plan view), as illustrated in FIGS. 19 and 20, the protruding portions 5 on the ring portion 3 pass through the thin-walled groove parts H on the upstream sides of the corresponding engaging protrusion portions 6 with respect to the rotational operation M and enter the corresponding engaging holes 6*a*. At this time, the upstream thin-walled groove parts H of the corresponding engaging protrusion portions 6 elastically expand, and the suspended portions 2*a* formed on the engaging protrusion portions 6 elastically warp outward owing to their cantilevered structure. Subsequently, the protruding portions 5 are fitted into the corresponding engaging protrusion portions 6, as illustrated in FIGS. 21, 22, and 23, placing the engaging protrusion portions 6 (the cap portion 2) in the locked state. If the cap portion 2 is rotated in the uncapping direction L shown in FIG. 8 while in this locked state, the lead angle allows the cap portion 2 to rise while rotating in the uncapping direction L. Consequently, the inner bottom surfaces of the engaging protrusion portions 6 defining the engaging holes 6*a* come into contact with the bottom surfaces of the corresponding protruding portions 5, and the protruding portions 5 prevent the cap portion 2 from rotating in the uncapping direction L.

Next, the unlocking process of the cap portion 2 in the locked state described above will be described with reference to FIGS. 24 and 25. When the ring portion 3 is rotated in the rotational operation M (clockwise in a plan view), the protruding portions 5 pass from the engaging holes 6*a* of the corresponding engaging protrusion portions 6 through the thin-walled groove parts H on the downstream sides in the rotational operation M. At this time, the thin-walled groove parts H of the corresponding engaging protrusion portions 6 elastically expand, and the suspended portions 2*a* on which the engaging protrusion portions 6 are formed elastically warp outward owing to their cantilevered structure. As the protruding portions 5 exit the engaging protrusion portions 6, the engaging protrusion portions 6 (the cap portion 2) shift from the locked state shown in FIGS. 21, 22, and 23 to the unlocked state shown in FIGS. 6 and 7.

As described above, the container 1 has the mouth portion K that includes the male thread part 1*a* formed around the upper portion, the annular bead 1*b* formed around the middle portion, and the annular shoulder 1*c* formed around the lower portion. The cap portion 2 is screwed onto the mouth portion K, with the male thread part 1*a* of the container 1 fitted in the female thread part 2*c*. The ring portion 3 is coupled to the bottom edge of the cap portion 2 through the breakaway part S and has elastic pieces 3*a* that fold upward to be anchored on the annular bead 1*b*. The ring portion 3 is capable of rotating freely between the annular bead 1*b* and annular shoulder 1*c*, and functions to indicate whether the breakaway part S has been broken. The locking mechanisms 4 can prevent the cap portion 2 from being rotated unintentionally in the uncapping direction L if the rotational operation M has been performed on the ring portion 3. Therefore, once the cap portion 2 is screwed onto the container 1, the locking mechanisms 4 prevent the cap portion 2 from being accidentally rotated in the uncapping direction L. By preventing the cap portion 2 from becoming unintentionally uncapped, this configuration can maintain the quality of the beverage accommodated in the container 1 by hindering a loss in flavor caused by the carbonation escaping from the beverage. The above configuration can also prevent vaporization or leakage of the solution, thereby enhancing safety for infants and the elderly. Further, the locking operation and unlocking operation can be performed simply by rotating the ring portion 3 in the rotational operation M. Thus, the construction of the first embodiment not only improves ease of use, but also increases the versatility of the container 1 in its applications.

The locking mechanisms 4 include protruding portions 5 provided on the outer circumferential surface of the ring portion 3 and having wedge-shaped end portions 5*a*. When the protruding portions 5 are fitted into the corresponding engaging protrusion portions 6 by rotating the ring portion 3 in the rotational operation M, the engaging protrusion portions 6 are in a locked state that prevents the cap portion 2 from being rotated unintentionally in the uncapping direction L. Further, the engaging protrusion portions 6 shift from the locked state to the unlocked state when the protruding portions 5 exit therefrom. Accordingly, this arrangement not only simplifies the structure of the locking mechanisms 4, but also facilitates manufacturing of the same. In addition, providing two sets of the protruding portions 5 and engaging protrusion portions 6 ensures a more stable locked state for the cap portion 2 and facilitates smooth locking and unlocking operations.

In the embodiment described above, the engaging protrusion portions 6 are provided with respective suspended portions 2*a* that are suspended from the outer peripheral surface of the cap portion 2. An engaging hole 6*a* is formed in each suspended portion 2*a* for being fitted with a corresponding protruding portion 5. Accordingly, protruding portions 5 can be easily fitted into and extracted from the corresponding engaging holes 6*a*, facilitating smooth locking and unlocking operations. Further, the sloped lower surfaces 6*b* formed on the bottoms of the suspended portions 2*a* slope gradually downward in the capping direction R of the cap portion 2. The sloped upper surfaces 5*b* formed on the tops of the protruding portions 5 also slope gradually downward in the capping direction R of the cap portion 2. Hence, the cap portion 2 can be smoothly rotated in the capping direction R, enabling the smooth capping and uncapping of the cap portion 2 by only performing such rotation. Further, the ring portion 3 is provided with the restricting protrusions 7, while the cap portion 2 is provided with contact portions 8 that contact the restricting protrusions 7 and that prevent the protruding portions 5 from being fitted in the corresponding engaging protrusion portions 6 when the cap portion 2 is rotated in the uncapping direction L. Accordingly, contact between the restricting protrusions 7 and the corresponding contact portions 8 prevents the protruding portions 5 from entering the engaging protrusion portions 6. This structure enables the cap portion 2 to be smoothly rotated in the uncapping direction L.

Next, the structure of a cap portion 2 according to a second embodiment will be described with reference to FIGS. 26 through 29. In the second embodiment, the cap portion 2 described in the first embodiment further includes two suspended circumferential walls 2*b*, 2*b*.

The suspended circumferential walls 2*b*, 2*b* are formed along the bottom circumference of the cap portion 2 in the areas between the suspended portions 2*a* so as to form a continuous annular shape with the suspended portions 2*a*, 2*a*. Thus, the addition of the suspended circumferential walls 2*b*,2*b* eliminates any awkwardness felt from the overall configuration of the cap portion 2 compared to the distinctive shape of the cap portion 2 in the first embodiment in which only the suspended portions 2*a* are suspended from the cap portion 2. This configuration can also facilitate the rotating operation of the cap portion 2 by setting the diameters of the suspended portions 2*a*, 2*a* and suspended circumferential walls 2*b*, 2*b* greater than the diameter of a main part of the cap portion 2.

Next, the structures of a cap portion 2 and a ring portion 3 according to a third embodiment will be described with reference to FIGS. 30 and 31. In the third embodiment, hooking portions 3*b* are formed on the ring portion 3 described in the first embodiment.

As shown in FIGS. 30 and 31, the hooking portions 3*b* are formed on opposing circumferential sides of the ring portion 3 so as to protrude upward from the same. The hooking portions 3*b* are capable of engaging with the engaging holes 6*a* of the corresponding engaging protrusion portions 6. By latching onto the engaging holes 6*a* of the engaging protrusion portions 6, the hooking portions 3*b* can retain the cap portion 2 when the cap portion 2 has been unscrewed, thereby preventing the cap portion 2 from being completely detached and potentially lost. This configuration can also facilitate the rotating operation for the ring portion 3 since the hooking portions 3*b* on the ring portion 3 have a larger diameter than the ring portion 3.

While the invention has been described in detail with reference to specific embodiments thereof, it will be appreciated to those skilled in the art that many modifications and variations may be made therein, including modifications to the material compositions and shapes of the container 1, cap portion 2, and ring portion 3 and to the structure of the locking mechanisms 4.

As described above in the preferred embodiments, the present invention can sufficiently achieve the desired objects.

While the description has been made in detail with reference to specific embodiments thereof, it would be apparent to those skilled in the art that various changes and modifications may be made therein without departing from the spirit and scope of the above described embodiments.

What is claimed is:

1. A cap for a container body including a mouth portion having an upper potion provided with a thread, a middle portion provided with an annular bead portion, and a lower portion provided with an annular shoulder portion; the cap comprising:

a cap portion configured to be screwed with the thread, the cap portion having a lower end;

a ring portion serving as a tamper-evident ring configured to be connected to the lower end of the cap portion through a breakaway part, the ring portion having an elastic piece folded and anchored on the annular bead portion and having an outer peripheral surface, the ring portion being rotatably provided between the annular bead portion and the annular shoulder portion so that a rotational operation is performable on the ring portion; and a locking mechanism configured to be operated by the rotational operation to prevent the cap portion from being unintentionally unscrewed, the locking mechanism comprising a protruding portion provided on the outer peripheral surface and having an end portion forming a wedge shape; and an engaging protrusion portion provided on the cap portion and configured to be engaged with the protruding portion by the rotational operation for providing a locked state to prevent the cap portion from being unintentionally unscrewed, the engaging protrusion portion being also configured to be disengaged from the protruding portion by the rotational operation for providing an unlocked state.

2. The cap according to claim 1, wherein the locking mechanism comprises:

a pair of engaging protrusion portions disposed on diametrically opposite positions on the cap portion; and a pair of protruding portions disposed on diametrically opposite positions on the outer peripheral surface, each of the pair of protruding portions having an end portion forming a wedge shape, the pair of engaging protrusion portions configured to be engaged with the pair of protruding portions by the rotational operation for providing the locked state to prevent the cap portion from being unintentionally unscrewed, the pair of engaging protrusion portions being also configured to be disengaged from the protruding portions by the rotational operation for providing the unlocked state.

3. The cap according to claim 1 wherein the cap portion has an outer circumferential surface; and wherein the engaging protrusion portion comprises a suspended portion cantilevered from the outer circumferential surface, the suspended portion forming an engaging hole configured to allow the protruding portion to be engaged therewith.

4. The cap according to claim 3, wherein the cap portion is configured to be screwed on the mouth portion in a capping direction;

wherein the suspended portion has a lower surface gradually sloping downward in the capping direction; and wherein the protruding portion has an upper surface gradually sloping downward in the capping direction.

5. The cap according to claim 3, wherein the cap portion is provided with a suspended circumferential wall on the outer circumferential surface at a position other than the suspended portion.

6. The cap according to claim 3, wherein the ring portion further comprises a hooking portion configured to hook the engaging hole.

7. The cap according to claim 1, wherein the ring portion further has a restricting protrusion; and wherein the cap portion further has a contact portion configured to contact the restricting protrusion to prevent the engaging protrusion portion from engaging with the protruding portion during uncapping of the cap portion.

8. A container comprising a container body and the cap according to claim 1.

* * * * *